US011191351B2

(12) United States Patent
Scholander

(10) Patent No.: US 11,191,351 B2
(45) Date of Patent: Dec. 7, 2021

(54) FOLDING LOCK MECHANISM FOR FURNITURE LEGS AND A PIECE OF FURNITURE WITH SUCH A MECHANISM

(71) Applicant: PANELTERRA INVESTMENTS LTD., Nicosia (CY)

(72) Inventor: Greger Scholander, Zhuhai (CN)

(73) Assignee: PANELTERRA INVESTMENTS LTD., Nicosia (CY)

( * ) Notice: Subject to any disclaimer, the term of this patent is extended or adjusted under 35 U.S.C. 154(b) by 0 days.

(21) Appl. No.: 16/982,920

(22) PCT Filed: Mar. 22, 2019

(86) PCT No.: PCT/EP2019/057222
§ 371 (c)(1),
(2) Date: Sep. 21, 2020

(87) PCT Pub. No.: WO2019/180196
PCT Pub. Date: Sep. 26, 2019

(65) Prior Publication Data

US 2021/0007475 A1 Jan. 14, 2021

(30) Foreign Application Priority Data

Mar. 22, 2018 (SE) ..... 1850322-7
Mar. 22, 2018 (VN) ..... 1-2018-01187

(51) Int. Cl.
*A47B 3/091* (2006.01)

(52) U.S. Cl.
CPC ..... *A47B 3/0912* (2013.01)

(58) Field of Classification Search
CPC ..... A47B 3/0912; A47B 3/0818
See application file for complete search history.

(56) References Cited

U.S. PATENT DOCUMENTS 2,278,810 A * 4/1942 Virtue ..... A47B 3/0912 403/92
2,374,670 A * 5/1945 Duke ..... A47B 3/0912 248/188.91

(Continued)

FOREIGN PATENT DOCUMENTS

FR 714159 A 11/1931

OTHER PUBLICATIONS

International Search Report for PCT/EP2019/057222 prepared by the European Patent Office, dated May 15, 2016, 3 pages.

*Primary Examiner* — Daniel J Rohrhoff
(74) *Attorney, Agent, or Firm* — Brooks Kushman P.C.

(57) ABSTRACT

A folding lock mechanism for furniture legs having a first connecting member arranged at an end portion of a first leg part and a second connecting member arranged at an end portion of a second leg part. The end portions of the leg parts are hingedly connected to each other such that the leg parts are arrangeable in a straight or a folded position. The first member includes a peg accommodated in a recess of the second leg part when the first and second leg parts are arranged in the straight position. The second member includes a spring biased pin arranged to be guided in a hole of the second leg part such that the pin can be engaged with the peg when the peg is accommodated in the recess of the second leg end part, thereby releasably locking the first and second leg parts in the straight position.

10 Claims, 7 Drawing Sheets

(56) References Cited

U.S. PATENT DOCUMENTS

| | | | | | |
|---|---|---|---|---|---|
| 2,689,158 | A * | 9/1954 | Mahr | A47B 3/0912 | 108/131 |
| 2,845,292 | A * | 7/1958 | Dunning | F16C 11/04 | 403/95 |
| 3,072,451 | A * | 1/1963 | Greenberg | A47B 3/0913 | 108/160 |
| 3,777,675 | A * | 12/1973 | Hanusiak | A47B 3/0912 | 108/132 |
| 5,865,128 | A * | 2/1999 | Tarnay | A47B 3/0912 | 108/133 |
| 6,901,867 | B2 | 6/2005 | Strong et al. | | |
| 6,920,833 | B2 * | 7/2005 | Lou-Hao | A47B 3/091 | 108/132 |
| 7,100,518 | B2 * | 9/2006 | Strong | A47B 3/087 | 108/132 |
| 8,550,012 | B2 * | 10/2013 | Rogers | A47B 3/0912 | 108/132 |

* cited by examiner

FOLDING LOCK MECHANISM FOR FURNITURE LEGS AND A PIECE OF FURNITURE WITH SUCH A MECHANISM

CROSS-REFERENCE TO RELATED APPLICATION

This application is the U.S. national phase of PCT Application No. PCT/EP2019/057222 filed on Mar. 22, 2019, which claims priority to SE Patent Application No. 1850322-7 filed on Mar. 22, 2018, and VN Patent Application No. 1-2018-01187 filed on Mar. 22, 2018, the disclosures of which are incorporated in their entirety by reference herein.

TECHNICAL FIELD

The present disclosure generally relates to a locking mechanism for folding furniture legs.

BACKGROUND

There is an increasing demand in today's environment for more flexible furniture where legs easily may be folded and moved.

Different types of locking mechanisms have been made for folding legs. One such lock for a folding table leg is disclosed in U.S. Pat. No. 2,695,827. In this form of lock, a latch member is pivotally mounted on a projecting ear on a cross-rail secured to the undersurface of the table and biased by means of a spring to engage a cross-member which connects the upper ends of a pair of legs for the table, thereby holding the legs of the table in an erected or unfolded position. In this type of table, the legs, when erected, are essentially perpendicular to the top of the table. However, such locking mechanisms may be quite complicated to manufacture. The mechanism may also be formed of many small parts that easily brakes, causes the table to be unstable or where the locking mechanism needs two hands to operate.

Therefore, there is a need for a locking mechanism that can easily be maneuvered and securely locked. Further there is also a need for increasing the locking mechanism's resistance to damage and at the same time decrease its overall dimensions.

SUMMARY

An objective of the present disclosure is therefore to at least partially fulfill the above requirements. This and other objectives are achieved by a locking mechanism for folding legs. Further embodiments of the present disclosure are provided in the dependent claims.

According to an aspect of the present inventive concept there is provided a folding lock mechanism for furniture legs. This lock mechanism may include a first connecting member arranged at an end portion of a first leg part and a second connecting member arranged at an end portion of a second leg part. The end portions of the first and second leg parts may be hingedly connected to each other such that the leg parts are arrangeable in a straight position and in a folded position. The first connecting member may include a peg configured to be accommodated in a recess of the second leg part when the first and second leg parts are arranged in the straight position. The second connecting member may include a spring biased pin arranged to be guided in a hole of the second leg part such that the pin can be engaged with the peg when the peg is accommodated in the recess of the second leg end part, thereby releasably locking the first and second leg parts in the straight position.

By using a peg that engages with a spring biased pin, an easy, rigid and efficient locking mechanism is achieved. The mechanism also provides a convenient and simple mechanism operating on folding legs.

It is also envisaged that the spring mechanism may be formed of other elastic means working in a similar way as a spring.

According to one embodiment, the first connecting member may be arranged in the leg direction such that it protrudes from the end portion of the first leg part. This protruding end portion may thus be understood as a portion extending in the longitudinal direction from the leg part.

In one embodiment, the peg may be tapered in order to facilitate the engagement between the peg and the pin.

In one embodiment, the peg may be arranged to extend in the transversal direction of the first connecting member. The term "transversal" hereby means a direction which is essentially perpendicular to the longitudinal, or length direction of the first connecting member such that the peg fit into the recess of the second leg part. Alternatively, or additionally, the term "transversal" may be understood as a direction perpendicular to the length direction of the first leg part.

In one embodiment, the recess may extend transversally into the second leg end part. The term "transversally" may hereby mean a direction which is perpendicular to the longitudinal direction of the second leg part such that the peg may fit into the recess of the second leg part. Thus, this recess extends into the second leg part. In this way the recess may fit or accommodate the peg when the leg parts are in a straight position. The recess may e.g. be a bore hole extending into the material of the leg part.

In one embodiment, the spring biased pin may be arranged in a transversal direction protruding into the side of the second leg end part and extending into the recess. This enables a simple and efficient engagement with the peg. Preferably, the direction is also perpendicular to the direction of the recess.

In one embodiment, the spring biased pin may be movable from a distal open position to a proximal closed position. The term "proximal" hereby refers to a state wherein the pin is in a proximal position relative to the center of the second leg part. The term "distal" hereby refers to a state wherein the pin is in a distal position relative to the center of the second leg part. An open position hereby means the state when the spring biased pin do not engage with the peg and the leg parts may be folded. A closed position hereby means the state when the spring biased pin engages with the peg and the leg parts are locked in a folded state.

In one embodiment, the peg may comprise engaging means in the form of a through hole or in the form of a cavity or a shoulder in the peg. By using a through hole, the pin and the peg may be securely locked together such that a great stability of the legs may be achieved. When the engaging means is a through hole in the peg, and the pin extends into the peg, the pin may be very fixed in the through hole of the peg such that no movement may occur. When there is a cavity or shoulder in the peg, the pin lies fixed against the cavity edge or the shoulder edge of the peg to stop any movements.

In one embodiment, the hinge may be arranged to allow the leg parts to move relative each other around a pivot axis.

In another aspect of the present inventive concept there is provided a piece of furniture comprising a first leg part, a second leg part and a folding lock mechanism as in the previous aspect. This aspect may generally present the same or corresponding advantages as the previous aspect.

In one embodiment, the piece of furniture comprises a third leg part arranged at a further end portion of the second leg part. The third leg part extends in a transversal direction to the extension of the first and second leg parts. In other words, the third leg part may be arranged to extend between the first leg part and the second leg part. The storing lock mechanism includes a third connecting member attached to the piece of furniture. The third connecting member includes a further spring biased pin and a further hole, wherein the further spring biased pin is arranged to be guided in the further hole such that the further spring biased pin can be engaged with a further recess in the third leg part, thereby releasably locking the first and second leg parts in a folded position.

This solution enables an efficient and simple way of locking the first and second leg parts in the folding position.

The present locking mechanism may generally be used for furniture's in gardens, offices or kitchens. In particular, on balconies such a locking mechanism may be very usable for folding or collapsing tables, stools, chairs and similar pieces of furniture in order to increase the use of space.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

Unless explicitly stated to the contrary, the drawings show only such elements that are necessary to illustrate the example embodiments, while other elements, in the interest of clarity, may be omitted or merely suggested. As illustrated in the figures, the sizes of elements and regions may be exaggerated for illustrative purposes and, thus, are provided to illustrate the general structures of the embodiments.

DETAILED DESCRIPTION

Exemplifying embodiments will now be described more fully hereinafter with reference to the accompanying drawings. The drawings show currently preferred embodiments, but the invention may, however, be embodied in many different forms and should not be construed as limited to the embodiments set forth herein; rather, these embodiments are provided for thoroughness and completeness, and fully convey the scope of the present disclosure to the skilled person.

With reference to FIGS. 1 to 4 different views of a folding lock mechanism 100 for a foldable leg are illustrated. The leg comprises a first leg part 101 and a second leg part 102.

Figure 1:
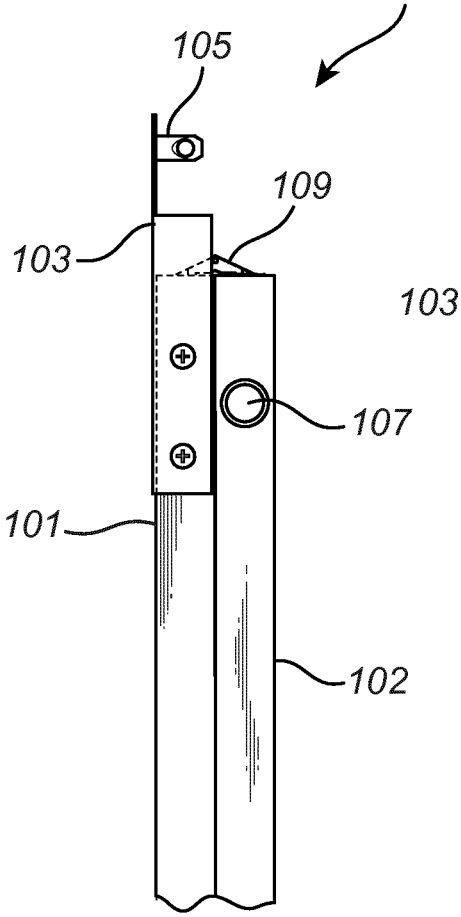
FIGS. 1 to 2 each show the locking mechanism, in cross section, when the leg parts are folded or in a straight position.
Figure 2:
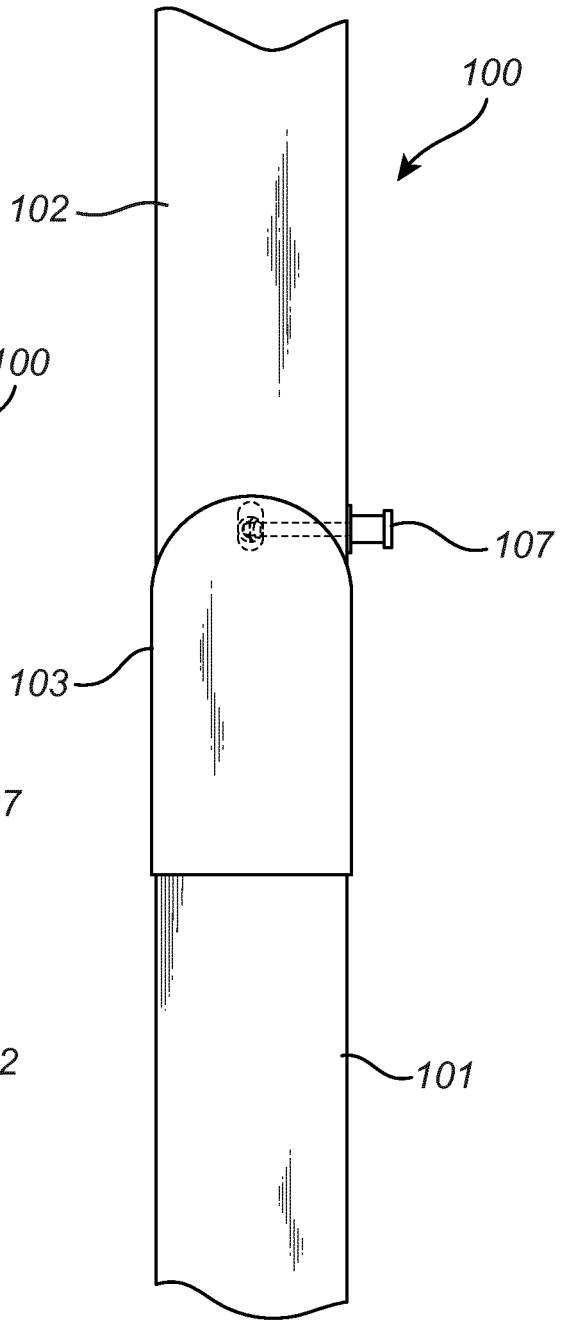
Figure 3:
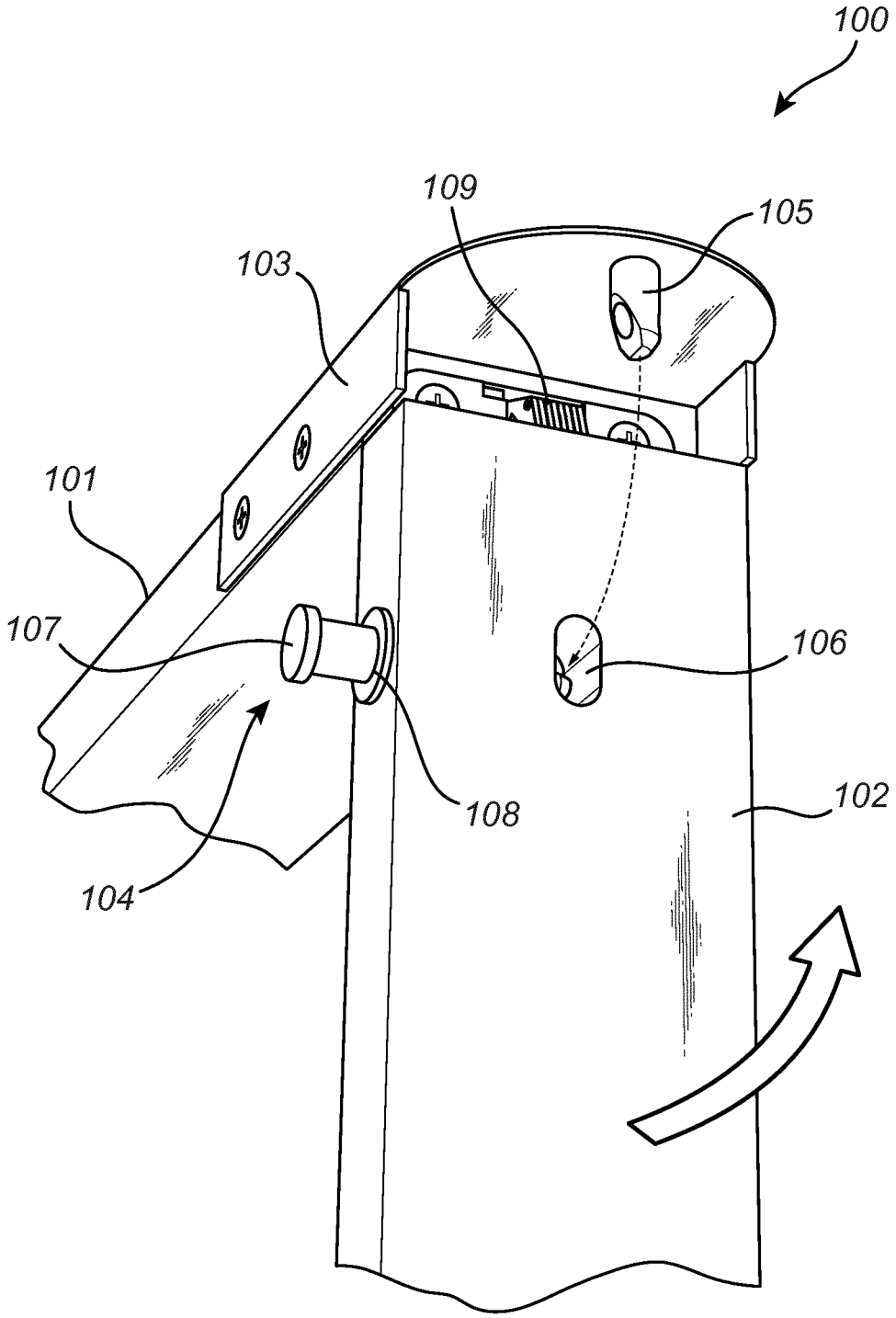
FIG. 3 shows the locking mechanism in perspective, when the leg parts are partly folded.

FIG. 1 illustrates the leg parts in a folded position, FIG. 2 illustrates the leg parts in a straight position, and FIG. 3 illustrates the leg parts in a position between the folded position and the straight position.

A first connecting member 103 may be arranged at an end portion 110 of the first leg part 101. The first connecting member 103 may be arranged in the leg direction protruding from the end portion 110 of the first leg part 101.

A second connecting member 104 may be arranged at an end portion of a second leg part 102. The end portions of the first 101 and second leg parts 102 may be joined together with a hinge 109. The hinge 109 may be arranged to allow the leg parts to move relative each other around a pivot axis. The end portions of the leg parts may then be movable between the folded position and the straight position.

The hinge 109 may be fixed at the leg part ends or at the sides of the end portions of the leg part, e.g. by means of screws. The hinge 109 may according to a non-limiting example be a joint hinge formed of steel to enable the best strength.

A peg 105 may be arranged in the transversal direction of the first connecting member 103. In particular, the peg 105 may be arranged in the protruding end portion 110 of the first connecting member 103. This transversal direction is perpendicular to the longitudinal direction of the first leg part. The peg 105 may be configured to be accommodated in a recess 106 of the second leg part 102. Thus, when the leg parts are in a straight position the peg 105 may fit in the recess 106 of the second leg part 102. Further, the second leg part 102 may include the recess 106 and a second connecting member 104. The recess 106 may protrude perpendicular into the second leg part 102 from a first side of the second leg part in order to fit the peg from the first connecting member 103. The recess 106 may go fully through the second leg part 102 on the other side as a through hole or the recess 106 may just go partly down into the second leg part 102.

The second connecting member 104 may include a spring biased pin 107 arranged to be guided in a hole 108. The spring biased pin 107 may be arranged in the hole 108 in a transversal direction protruding into a side of the second leg part 102 and extending into the recess 106. This protruding direction of the hole 108 is perpendicular to the direction of the recess 106 and perpendicular to the longitudinal direction of the second leg part 102. Here, this spring biased pin 107 may operate between an open position and a closed position. The open position is when the pin 107 is in a distal position relative to the center of the second leg part 102 and the spring is biased. The closed position is when the pin 107 is in a proximal position relative to the center of the second leg part with the spring fully extended to engage the pin 107 with the peg 105.

The peg 105 may include engaging means in the form of a through hole, but it may also be in the form of a cavity or a shoulder. The peg 105 may also be tapered to facilitate engagement with the spring biased pin 107. The engagement of the pin 107 and the peg 105 provides a rigid construction when the leg parts are locked.

The first 101 and second leg parts 102 may be releasably locked in the straight position by means of the locking mechanism such that the locking mechanism is configured to lock if the peg 105 is engaging with the spring biased pin 107, and unlock if the peg 105 is not engaging with the spring biased pin 107. In other words, when the spring biased pin 107 is closed it engages with the peg 105, and the leg parts are locked in a straight position. When the spring is opened or the spring biased pin 107 is released from the engagement with the peg 105, the leg parts may be folded.

Figure 4A:
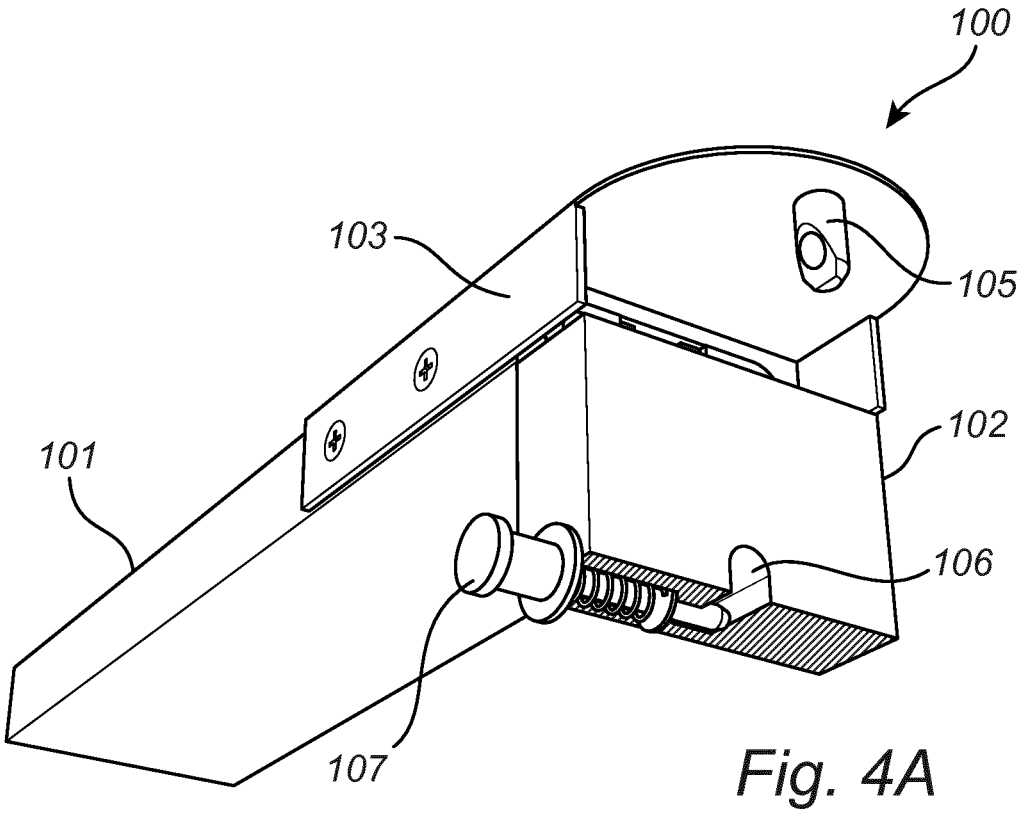
FIGS. 4A-4E shows the locking mechanism in perspective. Specifically, the spring biased pin is shown with a cross view of the second leg part and how the spring biased pin is engaging with the peg when the leg parts are in different positions.
Figure 4B:
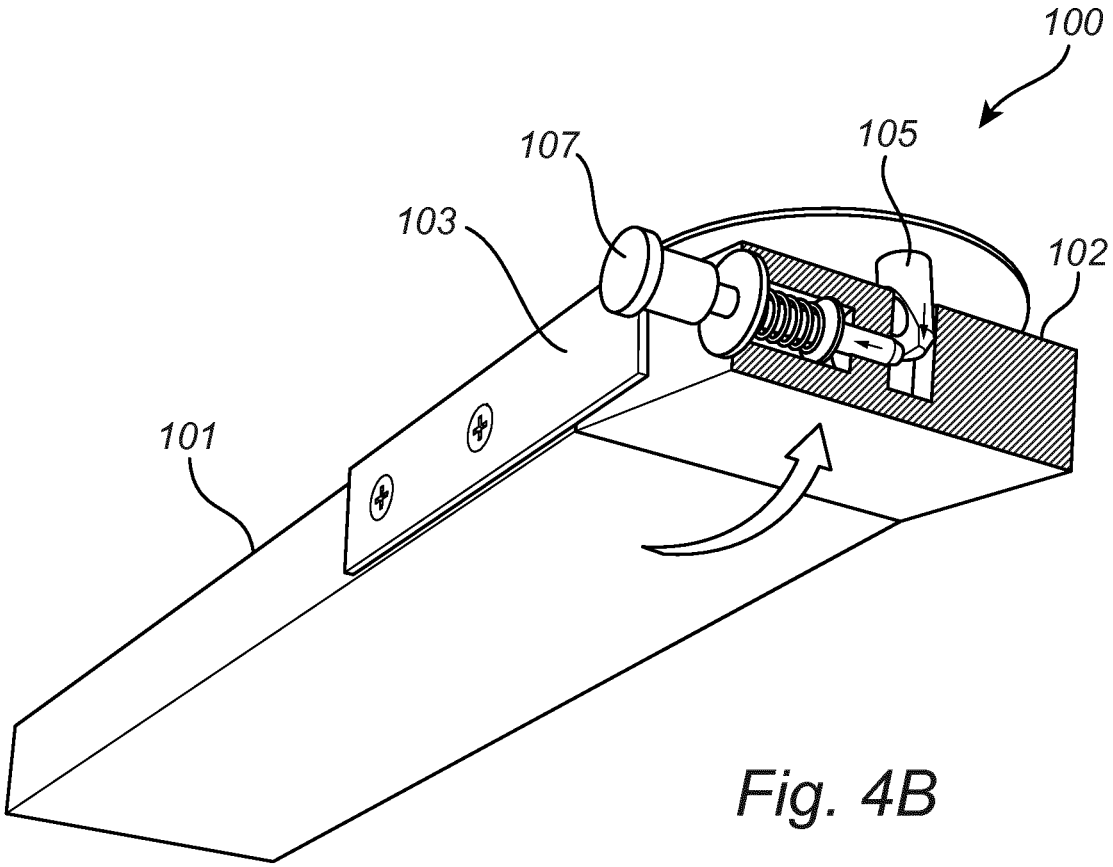
Figure 4C:
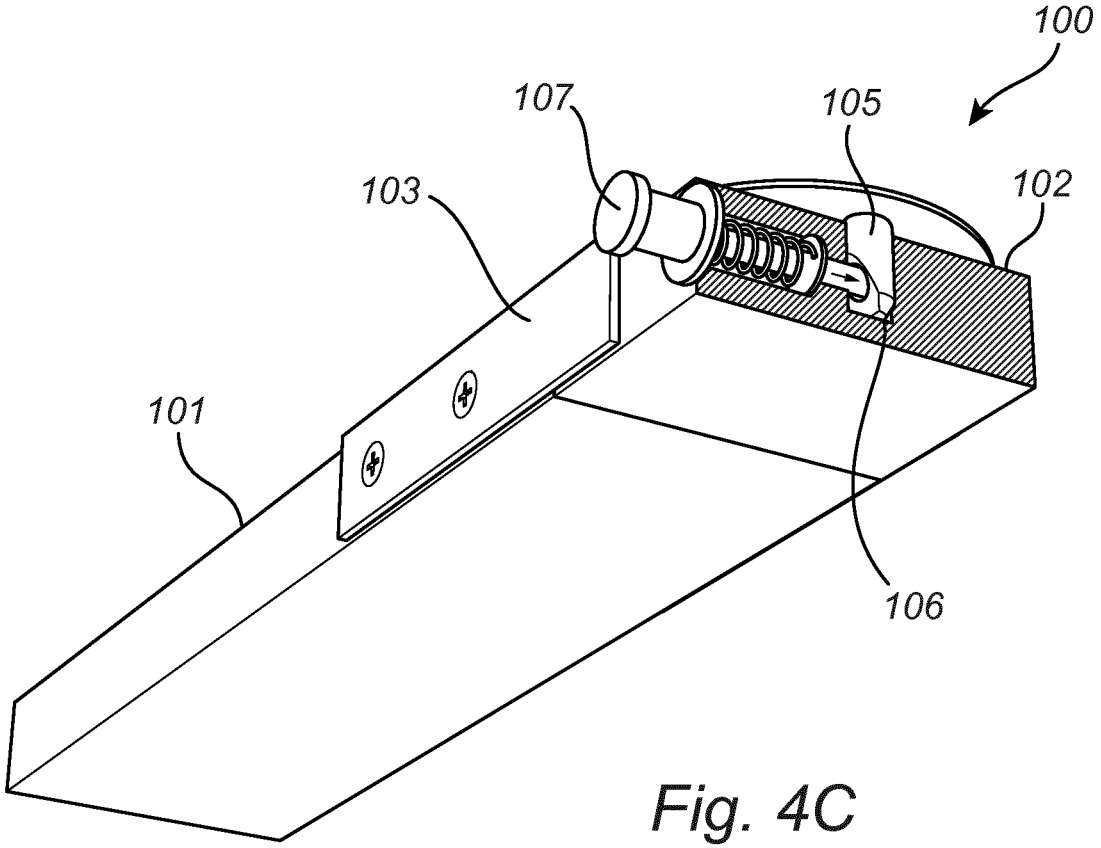
Figure 4D:
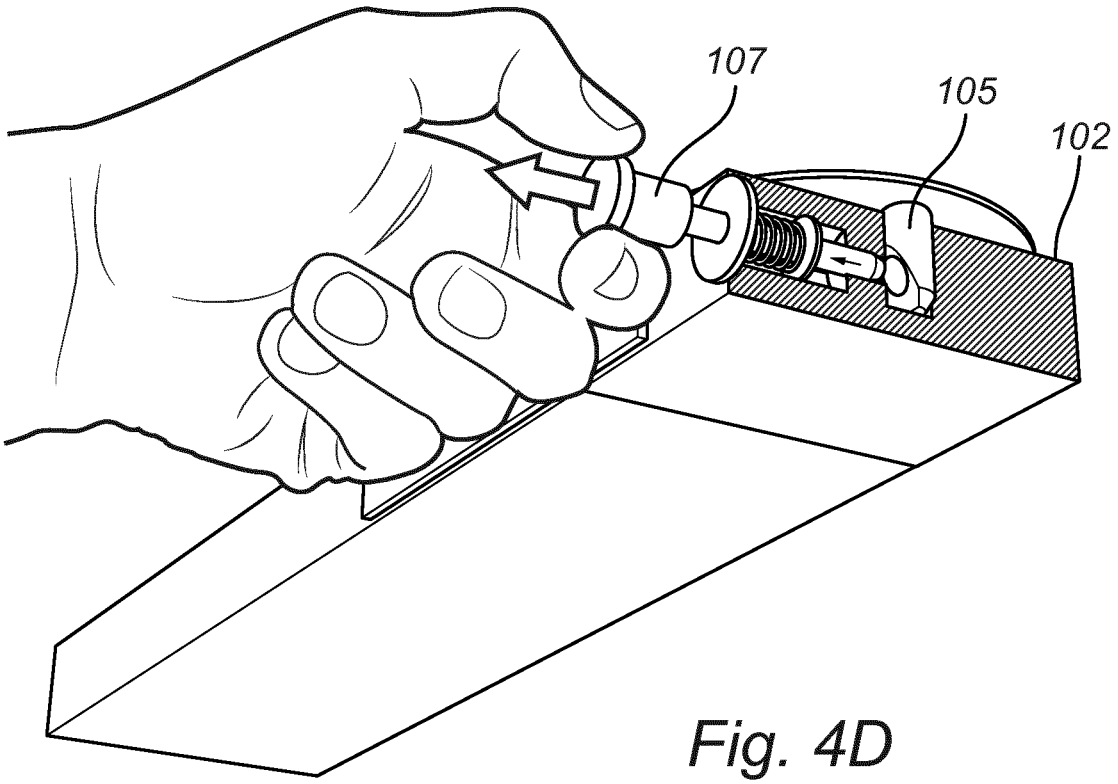
Figure 4E:
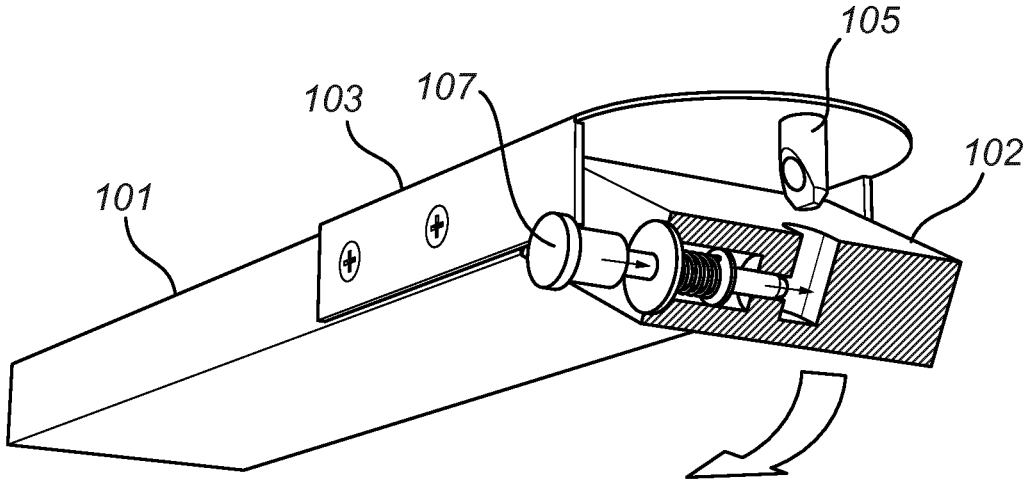

FIG. 4 A to C show how the spring biased pin 107 may engage with the peg 105 when the leg parts are moved from a partly folded position in FIGS. 4A and B to a straight position in FIG. 4C. FIG. 4D illustrates when the spring biased pin 107 may be released from the engagement with the peg 105 and the first and second leg parts are moved from the straight position to the partly folded position as shown in FIG. 4E.

Figure 5:
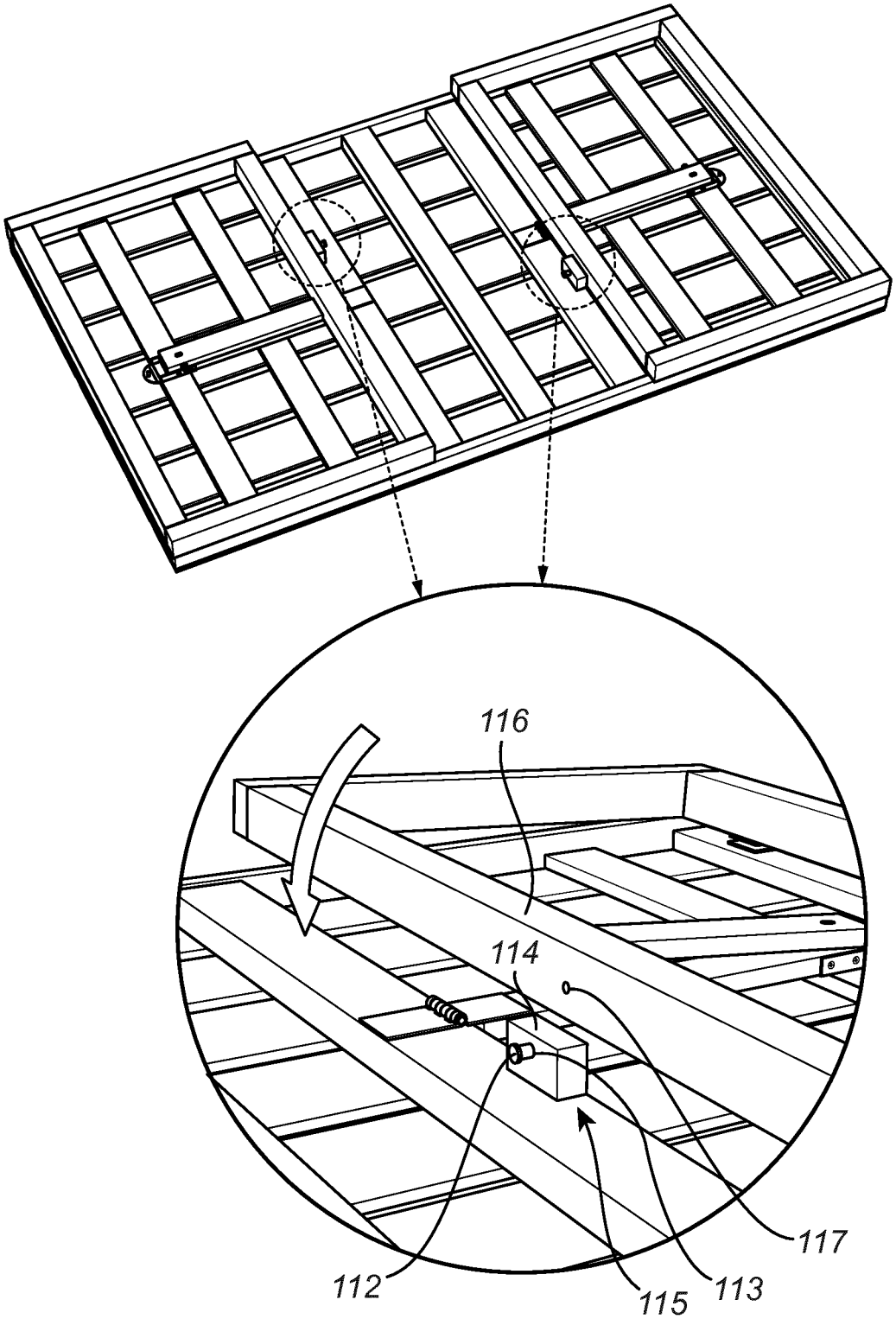
FIG. 5 shows the storing locking mechanism on the furniture, in perspective, when the leg parts are in a folded position.

FIG. 5 illustrates the storing lock mechanism 115 on a piece of furniture when the first 101 and second leg part 102 are in a folded position. This piece of furniture may be for example a table 111. A third leg part 116 may be arranged at a further end portion of the second leg part 102. This further end portion of the second leg part 102 may be at the opposite end of the second leg part 102 compared to the end portion that is arranged at the second connecting member 104. Alternatively, the third leg part 116 may be arranged at a further end portion of the first leg part 101. However, the third leg part 116 may only be arranged on either the further end portion of the first leg part 101 or at the further end portion of the second end part 102, and not arranged at both at the same time.

In the following, only the embodiment when the third leg part is arranged at the further end portion of the second leg part 102 will be described. The third leg part 116 may extend in a transversal direction between the first leg part 101 and the second leg part 102. This third leg part 116 may work as a stabilizer for the table 111 when the first 101 and second leg part 102 are in a straight position. A further recess 117 may be located in the third leg part 116. A third connecting member 114 may be attached to the table 111. This third connecting member 114 may comprise a further spring biased pin 112 arranged to be guided in a further hole 113 of the third connecting member 114. When the first 101 and second leg part 102 are in the folded position, the second spring biased pin 112 may engage with the further recess 117 in the third leg part 116 and thereby releasably locking the first 101 and second leg part 102 in the folded position.

The term "further" may hereby also be referred to as "second" e.g. second recess, second spring biased member, second hole or second end portion.

In a non-limiting example, the folding lock mechanism 100 may preferably be used on legs for tables but may also be used on legs to chairs. The folding lock mechanism may be made of metal as for example stainless steel to allow for the best stability, but may also be made of plastic to become as light as possible. The first connecting member 103 may for example be formed or a sheet metal that may be screwed into the end portion of the first leg part 101. The peg 105 may be screwed into the connecting member. Alternatively, the first connecting member 103 and the peg may be formed in one piece of metal or plastic. The hole 108 may be formed by drilling into the first side of the second leg part 102. The spring biased pin 107 may be made of metal or plastic and screwed into the hole 108 to achieve a fixed position for a housing to the spring biased pin 107 where the pin 107 may be movable. The recess 106 may be formed by drilling into the second leg part 102, such that the hole 108 extends perpendicular out into the recess 106. The leg parts may for example be made of any kind of plastic, metal or wood and may be for example cylindrical or square shaped. The third connecting member 114 may be made of wooden or plastic and attached to the table by screws. The further recess 117 is formed by drilling into the third leg part 116. The further spring biased pin 112 may be made of plastic or metal and screwed into the further hole 113

Figure 6:
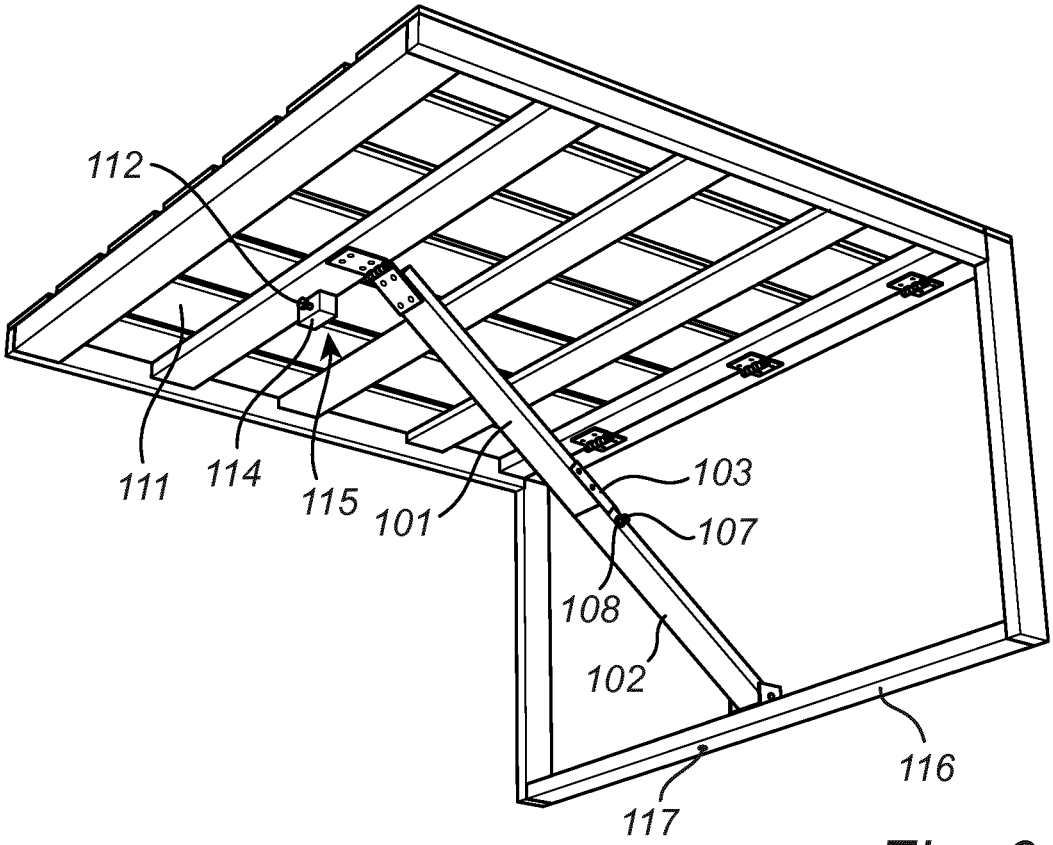
FIG. 6 shows a table using the locking mechanism on a foldable leg to lock the leg parts in a straight position.

FIG. 6 illustrates the folding lock mechanism 100 used on a leg for a table 111, as for example a balcony table. In this example, the foldable leg is in the straight position and the folding lock mechanism 100 is locking the first 101 and second leg part 102 in this position. The first and second leg parts may then in a simple manner be folded up against the underside of the table 111. When the first and second leg parts then are folded, the storing lock mechanism 115 which is attached to the table may lock the first 101 and second leg part 102 in the folded position with help of the further spring biased pin 112. The spring biased pin 112, arranged in the third connecting member 114 may engage with the further recess 117 in the third leg part 116 to lock the first and second leg parts in the folded position.

In the above the inventive concept has mainly been described with reference to a limited number of examples. However, as is readily appreciated by a person skilled in the art, other examples than the ones disclosed above are equally possible within the scope of the inventive concept, as defined by the appended claims.

The invention claimed is:

1. A folding lock mechanism for furniture legs comprising:

a first connecting member arranged at an end portion of a first leg part; and a second connecting member arranged at an end portion of a second leg part, wherein the end portions of the first and second leg parts are hingedly connected to each other such that the leg parts are rotatable relative to each other around an axis of rotation and arrangeable in a straight position and in a folded position;

wherein:

the first connecting member comprises a peg configured to be moved together with the first leg part in a direction orthogonal to the axis of rotation and into a recess of the second leg part, such that the peg is accommodated in the recess when the first and second leg parts are arranged in the straight position;

the second connecting member comprises a spring biased pin arranged to be guided in a hole in the second leg part such that the pin can be engaged with the peg when the peg is accommodated in the recess of the second leg end part, thereby releasably locking the first and second leg parts in the straight position.

2. The mechanism according to claim 1, wherein the first connecting member is arranged to protrude, in a length direction of the first leg part, from the end portion of the first leg part.

3. The mechanism according to claim 1, wherein the peg is tapered in order to slide against the spring biased pin.

4. The mechanism according to claim 1, wherein the peg is arranged in a transversal direction of the first leg part.

5. The mechanism according to claim 1, wherein the recess extends transversally into the second leg end part.

6. The mechanism according to claim 1, wherein the spring biased pin is arranged in a transversal direction of the second leg part, protruding into the side of the second leg end part and extending into the recess.

7. The mechanism according to claim 1, wherein the spring biased pin is movable from a distal open position to a proximal closed position, relative a center of the second leg part.

8. The mechanism according to claim 1, wherein the peg comprises engaging means in the form of a through hole, a cavity or a shoulder.

9. A piece of furniture comprising a first leg part, a second leg part and a folding lock mechanism according to claim 1.

10. A piece of furniture comprising a first leg part, a second leg part and a folding lock mechanism, the folding locking mechanism including:

a first connecting member arranged at an end portion of a first leg part;

a second connecting member arranged at an end portion of a second leg part, wherein the end portions of the first and second leg parts are hingedly connected to each other such that the leg parts are rotatable relative to each other around an axis of rotation and arrangeable in a straight position and in a folded position; and a third leg part arranged at a second end portion of the second leg part, the third leg part extending in a transversal direction to the extension of the first and second leg parts; and a storing lock mechanism comprising a third connecting member attached to the piece of furniture, the third connecting member comprising a further spring biased pin and a second hole, wherein the further spring biased pin is arranged to be guided in the further hole such that the further spring biased pin can be engaged with a further recess in the third leg part, thereby releasably locking the first and second leg parts in a folded position;

wherein:

the first connecting member comprises a peg configured to be moved together with the first leg part in a direction orthogonal to the axis of rotation and into a recess of the second leg part, such that the peg is accommodated in the recess when the first and second leg parts are arranged in the straight position; and the second connecting member comprises a spring biased pin arranged to be guided in a hole in the second leg part such that the pin can be engaged with the peg when the peg is accommodated in the recess of the second leg end part, thereby releasably locking the first and second leg parts in the straight position.

* * * * *